US012715488B2

(12) United States Patent
Fujiwara et al.

(10) Patent No.: US 12,715,488 B2
(45) Date of Patent: Aug. 25, 2026

(54) CONVEYANCE SYSTEM, METHOD FOR CONTROLLING CONVEYANCE SYSTEM, AND STORAGE MEDIUM

(71) Applicant: DAIFUKU CO., LTD., Osaka (JP)

(72) Inventors: Yosuke Fujiwara, Komaki (JP); Hiroyoshi Toba, Komaki (JP); Kenji Tamura, Gamo-gun (JP)

(73) Assignee: DAIFUKU CO., LTD., Osaka (JP)

( * ) Notice: Subject to any disclaimer, the term of this patent is extended or adjusted under 35 U.S.C. 154(b) by 571 days.

(21) Appl. No.: 18/343,067

(22) Filed: Jun. 28, 2023

(65) Prior Publication Data

US 2024/0043055 A1 Feb. 8, 2024

(30) Foreign Application Priority Data

Aug. 8, 2022 (JP) ..... 2022-126605

(51) Int. Cl.
*B61L 27/16* (2022.01)
*B61B 3/02* (2006.01)

(52) U.S. Cl.
CPC ..... *B61L 27/16* (2022.01); *B61B 3/02* (2013.01)

(58) Field of Classification Search
CPC ..... B61B 3/02; B61L 27/16; G05B 19/4189
See application file for complete search history.

(56) References Cited

U.S. PATENT DOCUMENTS 9,520,313 B2 * 12/2016 Ota ..... H01L 21/67769
10,497,594 B2 * 12/2019 Suzuki ..... B65G 1/0464
11,325,785 B2 * 5/2022 Ueda ..... B65G 43/00
12,434,915 B2 * 10/2025 Yamada ..... B65G 43/10
2006/0051192 A1 * 3/2006 Fujiki ..... B65G 47/5104 414/626
2015/0045937 A1 * 2/2015 Yamamoto ..... H01L 21/67294 700/121
2018/0265297 A1 * 9/2018 Nakano ..... B65G 1/1373
2022/0161832 A1 * 5/2022 Ueda ..... B61G 7/00
2023/0170237 A1 * 6/2023 Ito ..... H01L 21/67736 414/496
2024/0043055 A1 * 2/2024 Fujiwara ..... H01L 21/67727
(Continued)

FOREIGN PATENT DOCUMENTS

CN 104302562 A * 1/2015 ..... H01L 21/67733
IL 257409 A * 4/2018 ..... H01L 21/67736
(Continued)

OTHER PUBLICATIONS

Japanese Office Action and English translation thereof for Japanese Application No. 2022-126605 mailed Jun. 24, 2025.

*Primary Examiner* — Jason C Smith
(74) *Attorney, Agent, or Firm* — Harness, Dickey & Pierce, P.L.C.

(57) ABSTRACT

In order to efficiently convey a conveyance target, a conveyance system includes: a carriage configured to be capable of conveying a plurality of conveyance targets; and a carriage controller configured to perform an allocation process of allocating, to the carriage, a conveyance target to be conveyed, the carriage controller performing the allocation process such that, in a case where a region in which the carriage is movable is divided into a plurality of areas, areas of destinations of the plurality of conveyance targets that are to be simultaneously conveyed by the carriage are the same.

9 Claims, 7 Drawing Sheets

(56) References Cited

U.S. PATENT DOCUMENTS

| | | | | |
|---|---|---|---|---|
| 2024/0067459 | A1* | 2/2024 | Kimura | B65G 43/00 |
| 2025/0219920 | A1* | 7/2025 | Shibata | H04B 17/318 |
| 2025/0296782 | A1* | 9/2025 | Seki | B65G 43/02 |

FOREIGN PATENT DOCUMENTS

| | | | | | |
|---|---|---|---|---|---|
| JP | 2004227060 | A | * | 8/2004 | |
| JP | 2005022539 | A | | 1/2005 | |
| JP | 2007137642 | A | * | 6/2007 | |
| TW | 202407480 | A | * | 2/2024 | B65G 1/137 |
| WO | 2021/220621 | A1 | | 11/2021 | |
| WO | WO-2023188769 | A1 | * | 10/2023 | B65G 17/12 |

* cited by examiner

FIG. 4

251

| CARRIAGE ID | TRANSFER SECTION A | TRANSFER SECTION B | DESTINATION | CURRENT POSITION |
|---|---|---|---|---|
| XXX0001 | FOUPaaaa | FOUPbbbb | FIRST BAY | aaaaaa |
| XXX0002 | FOUPcccc | FOUPdddd | FIRST BAY | aaaaab |
| XXX0003 | | FOUPeeee | FIRST BAY | bbbbbc |
| XXX0004 | | | | cccccc |
| XXX0005 | FOUPffff | FOUPgggg | FIRST BAY | dddddde |
| ... | | | ... | ... |

251'

| CARRIAGE ID | TRANSFER SECTION | SHELF | DESTINATION | CURRENT POSITION |
|---|---|---|---|---|
| XXX0001 | FOUPhhhh | FOUPzzzz | FIRST BAY | aaaaaa |
| XXX0002 | | FOUPkkkk | FIRST BAY | aaaaab |
| XXX0003 | | FOUPnnnn | FIRST BAY | bbbbbc |
| XXX0004 | | | | cccccc |
| XXX0005 | FOUPqqqq | FOUPrrrr | FIRST BAY | dddddde |
| ... | | | ... | ... |

CONVEYANCE SYSTEM, METHOD FOR CONTROLLING CONVEYANCE SYSTEM, AND STORAGE MEDIUM

This Nonprovisional application claims priority under 35 U.S.C. § 119 on Patent Application No. 2022-126605 filed in Japan on Aug. 8, 2022, the entire contents of which are hereby incorporated by reference.

TECHNICAL FIELD

The present invention relates to, for example, a conveyance system and the like that convey a conveyance target with use of a carriage which travels along a track.

BACKGROUND ART

Known is a conveyance system that conveys a conveyance target by causing a carriage to travel along a track disposed on a ceiling. For example, Patent Literature 1 discloses a carriage that includes a plurality of loading sections and that is attached to a ceiling with a track interposed between the carriage and the ceiling. The carriage disclosed in Patent Literature 1 is of a suspension type in which the plurality of loading sections can individually load and unload conveyance targets.

CITATION LIST

Patent Literature

Patent Literature 1

Japanese Patent Application Publication Tokukai No. 2005-22539

SUMMARY OF INVENTION

Technical Problem

The above-described technique disclosed in Patent Literature 1 uses a plurality of loading sections on an individual basis to convey conveyance targets. Conveyance efficiency of a carriage that can load a plurality of conveyance targets depends on departure places and destinations of loaded conveyance targets. However, no mention of departure places and destinations of the conveyance targets is made in Patent Literature 1. Therefore, the technique disclosed in Patent Literature 1 has a room for improvement in terms of improving the efficiency of conveyance.

An aspect of the present invention is achieved in light of the foregoing problem. It is an object of the aspect of the present invention to achieve a conveyance system and the like including a carriage which can load a plurality of conveyance targets, the conveyance system efficiently conveying the conveyance targets.

Solution to Problem

In order to attain the object, a conveyance system in accordance with an aspect of the present invention includes: a carriage configured to be capable of conveying a plurality of conveyance targets; and a control device configured to perform an allocation process of allocating, to the carriage, a conveyance target to be conveyed, the control device performing the allocation process such that, in a case where a region in which the carriage is movable is divided into a plurality of areas, areas of destinations of the plurality of conveyance targets that are to be simultaneously conveyed by the carriage are the same.

In addition, in order to attain the object, a control method in accordance with an aspect of the present invention is a method for controlling a conveyance system including a plurality of carriages each configured to be capable of conveying a plurality of conveyance targets, the method including the steps of: acquiring conveyance information including a departure place of a conveyance target to be conveyed and a destination of the conveyance target; and allocating, to the carriage, the conveyance target to be conveyed with use of the conveyance information such that, in a case where a region in which the carriage is movable is divided into a plurality of areas, areas of destinations of the plurality of conveyance targets that are to be simultaneously conveyed by the carriage are the same.

Advantageous Effects of Invention

According to an aspect of the present invention, it is possible to allocate the carriage such that areas of destinations of the conveyance targets which are being conveyed are the same, and thus it is possible to perform efficient conveyance.

BRIEF DESCRIPTION OF DRAWINGS

FIG. 4 is a view illustrating an example of carriage data stored in a storage section.

DESCRIPTION OF EMBODIMENTS

Overview

Figure 1:
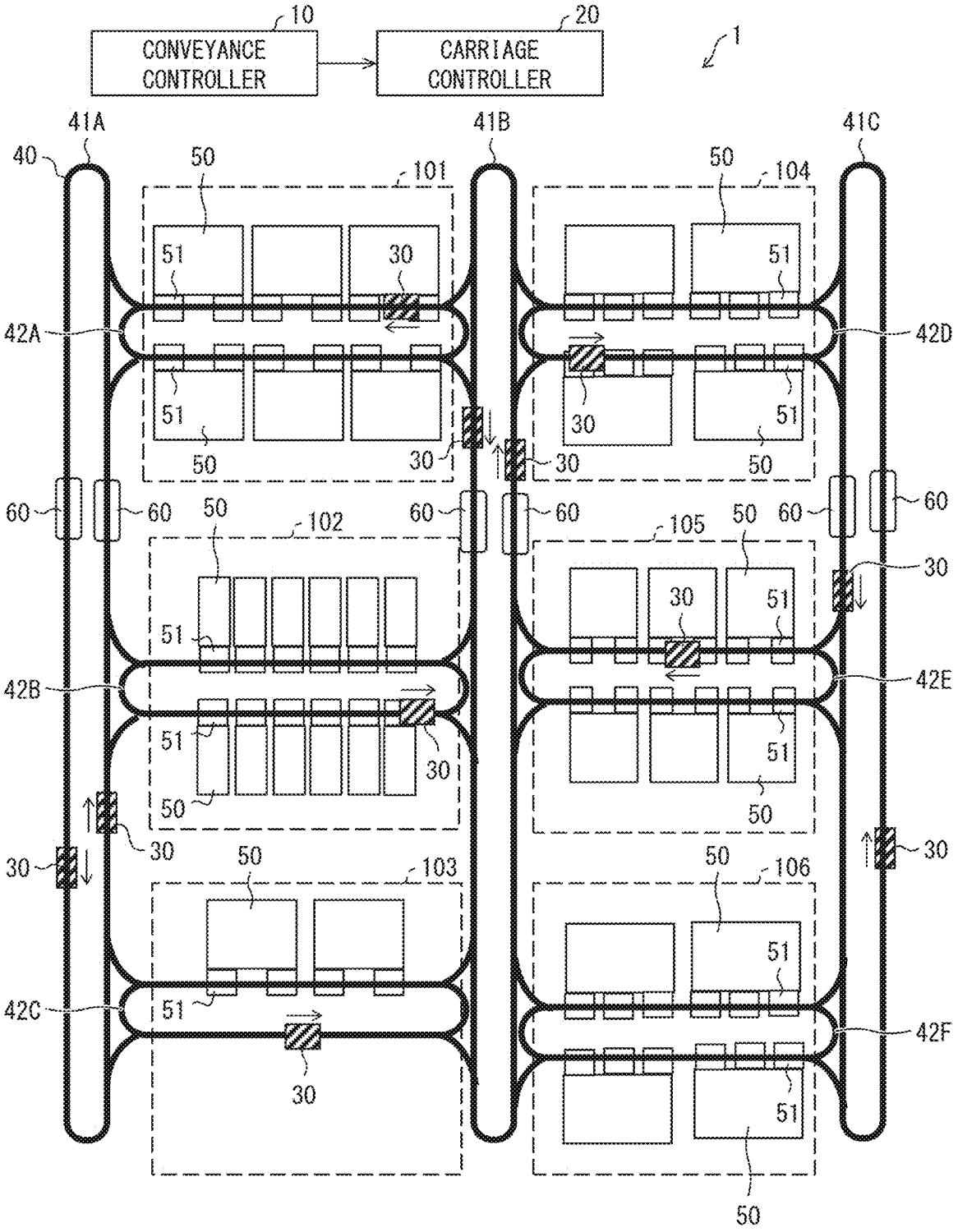
FIG. 1 is a view illustrating a layout of a track for carriages in a conveyance system in accordance with an embodiment of the present invention.

The following will describe an embodiment of the present invention in detail. First, with reference to FIG. 1, an overview of a conveyance system 1 will be described. FIG. 1 is a view illustrating a layout of a track 40 for carriages 30 in a conveyance system 1.

The conveyance system 1 is configured to, with use of one or more carriages 30 capable of travelling along a track 40, convey a conveyance target F across conveyance areas (in the present embodiment, referred to as bays) each of which includes a plurality of processing devices 50 that perform identical or similar processes in, for example, a semiconductor processing plant and the like. The conveyance areas can be defined also as a plurality of divided regions across which the carriage 30 can move.

In an example illustrated in FIG. 1, as the conveyance areas, a first bay 101 to a sixth bay 106 are illustrated. The track 40 is disposed along a ceiling. In addition, the track 40 includes: an inter-bay circular track 41 (first circular track)

which is disposed so as to enable the conveyance target F to be conveyed across the bays; and an intra-bay circular track 42 (second circular track) which is disposed so as to enable the conveyance target F to be conveyed within the bay.

More specifically, the inter-bay circular track 41 includes an inter-bay circular track 41A, an inter-bay circular track 41B, and an inter-bay circular track 41C. The inter-bay circular track 41A enables the conveyance target F to be conveyed across the first bay 101, the second bay 102, and the third bay 103. The inter-bay circular track 41B enables the conveyance target F to be conveyed across the first bay 101, the second bay 102, the third bay 103, the fourth bay 104, the fifth bay 105, and the sixth bay 106. The inter-bay circular track 41C enables the conveyance target F to be conveyed across the fourth bay 104, the fifth bay 105, and the sixth bay 106.

Further, the intra-bay circular track 42 includes an intra-bay circular track 42A, an intra-bay circular track 42B, an intra-bay circular track 42C, an intra-bay circular track 42D, an intra-bay circular track 42E, and an intra-bay circular track 42F. The intra-bay circular track 42A enables the conveyance target F to be conveyed in the first bay 101. The intra-bay circular track 42B enables the conveyance target F to be conveyed in the second bay 102. The intra-bay circular track 42C enables the conveyance target F to be conveyed in the third bay 103. The intra-bay circular track 42D enables the conveyance target F to be conveyed in the fourth bay 104. The intra-bay circular track 42E enables the conveyance target F to be conveyed in the fifth bay 105. The intra-bay circular track 42F enables the conveyance target F to be conveyed in the sixth bay 106.

In addition, the intra-bay circular track 42A, the intra-bay circular track 42B, and the intra-bay circular track 42C are each connected with the inter-bay circular track 41A and the inter-bay circular track 41B. The intra-bay circular track 42D, the intra-bay circular track 42E, and the intra-bay circular track 42F are each connected with the inter-bay circular track 41B and the inter-bay circular track 41C. Thus, the carriage 30 can travel between the inter-bay circular track 41 and the intra-bay circular track 42. In other words, the carriage can efficiently move across the bays and within the bay.

The carriage 30 can convey the conveyance target F from a departure place of the conveyance target F to a destination thereof by travelling along the track That is, the carriage 30 can move across the bays by travelling along the inter-bay circular track 41 included in the track 40 and can move within the bay by travelling along the intra-bay circular track 42 included in the track 40.

The first bay 101 to the sixth bay 106 each include the plurality of processing devices 50 which perform identical or similar processes. In addition, each of the processing devices 50 includes one or more device ports 51 on which the conveyance target(s) F to be processed by the processing device 50 is/are to be placed.

Thus, it is desired that the conveyance targets F to be subjected to identical or similar processes be conveyed to the same bay. This makes it possible to improve the conveyance efficiency as compared with the case where the processing devices 50 that perform identical or similar processes are disposed in different bays.

The conveyance system 1 further includes one or more ceiling storage shelves 60 for storing the conveyance targets F. In an example illustrated in FIG. 1, the ceiling storage shelves 60 are disposed along the inter-bay circular tracks 41A, 41B, and 41 C.

Figure 2:
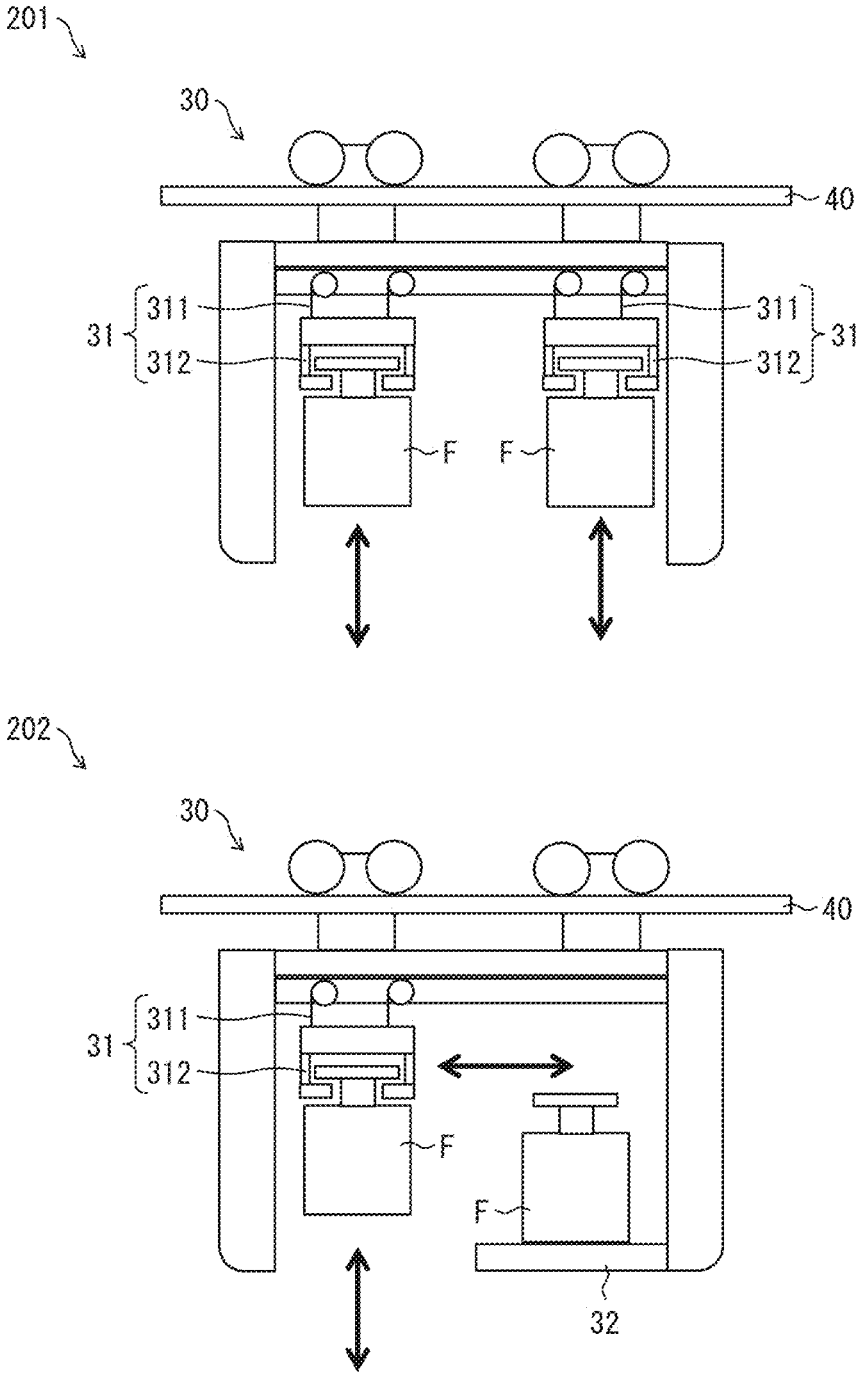
FIG. 2 is a view illustrating a configuration example of the carriage.

The carriage 30 is configured to travel in one direction along the track 40 to convey the conveyance target F. With reference to FIG. 2, the following will describe details of the carriage 30. FIG. 2 is a view illustrating a structure of the carriage 30. Reference numbers 201 and 202 of FIG. 2 each illustrate an example of the carriage 30. The reference number 201 of FIG. 2 illustrates an example of the carriage 30 including two transfer sections 31. In the example illustrated in the reference number 201, the carriage 30 includes the two transfer sections 31, and the transfer sections 31 each include a raising and lowering part 311 and a gripping part 312. The raising and lowering part 311 is configured to raise and lower the gripping part 312 in a vertical direction. The gripping part 312 is configured to grip the conveyance target F.

In a case where the conveyance target F is conveyed and/or transferred, the carriage 30 first stops at a position above the conveyance target F. Then, the gripping part 312 is lowered by the raising and lowering part 311 and then grips the conveyance target F. Subsequently, the raising and lowering part 311 raises the gripping part 312 in a state where the gripping part 312 grips the conveyance target F. In this state, the carriage 30 conveys the conveyance target F. On arrival at the destination, the raising and lowering part 311 lowers the gripping part 312 to place the conveyance target F and then raises the gripping part 312. Accordingly, the carriage 30 can transfer the conveyance target F from the departure place to the destination. Note that, in the example illustrated in the reference number 201 of FIG. 2, the carriage 30 includes the two transfer sections 31, so that each of the transfer sections 31 can convey and transfer the conveyance target F.

The reference number 202 of FIG. 2 illustrates a carriage 30', which is another example of the carriage 30. The carriage 30' includes a single transfer section 31 and a single shelf 32. The transfer section 31 can move in a horizontal direction and can place the conveyance target F onto the shelf 32 by causing the conveyance target F gripped by the gripping part 312 to move in a horizontal direction in the carriage 30'. Thus, even in a case where only the single transfer section 31 is included, it is possible to convey and transfer two conveyance targets F. Note, here, that the description above takes, as an example, the case where the carriage 30 conveys two conveyance targets F, but the present invention is not limited to this. The carriage 30 may convey three or more conveyance targets F.

The conveyance system 1 further includes a conveyance controller (control device) 10 and a carriage controller (control device) 20. The conveyance controller 10 is configured to perform a process of controlling an entire conveyance process in the conveyance system 1. In addition, the conveyance controller 10 performs, in accordance with an inquiry from the carriage controller 20, a process of designating a device port 51 on which the conveyance target F is to be placed. The carriage controller 20 is configured to control the carriage 30 in accordance with an instruction from the conveyance controller 10. The conveyance controller 10 and the carriage controller 20 are each, for example, an electronic control unit including a central processing unit (CPU), a read only memory (ROM), a random access memory (RAM), and the like.

Figure 3:
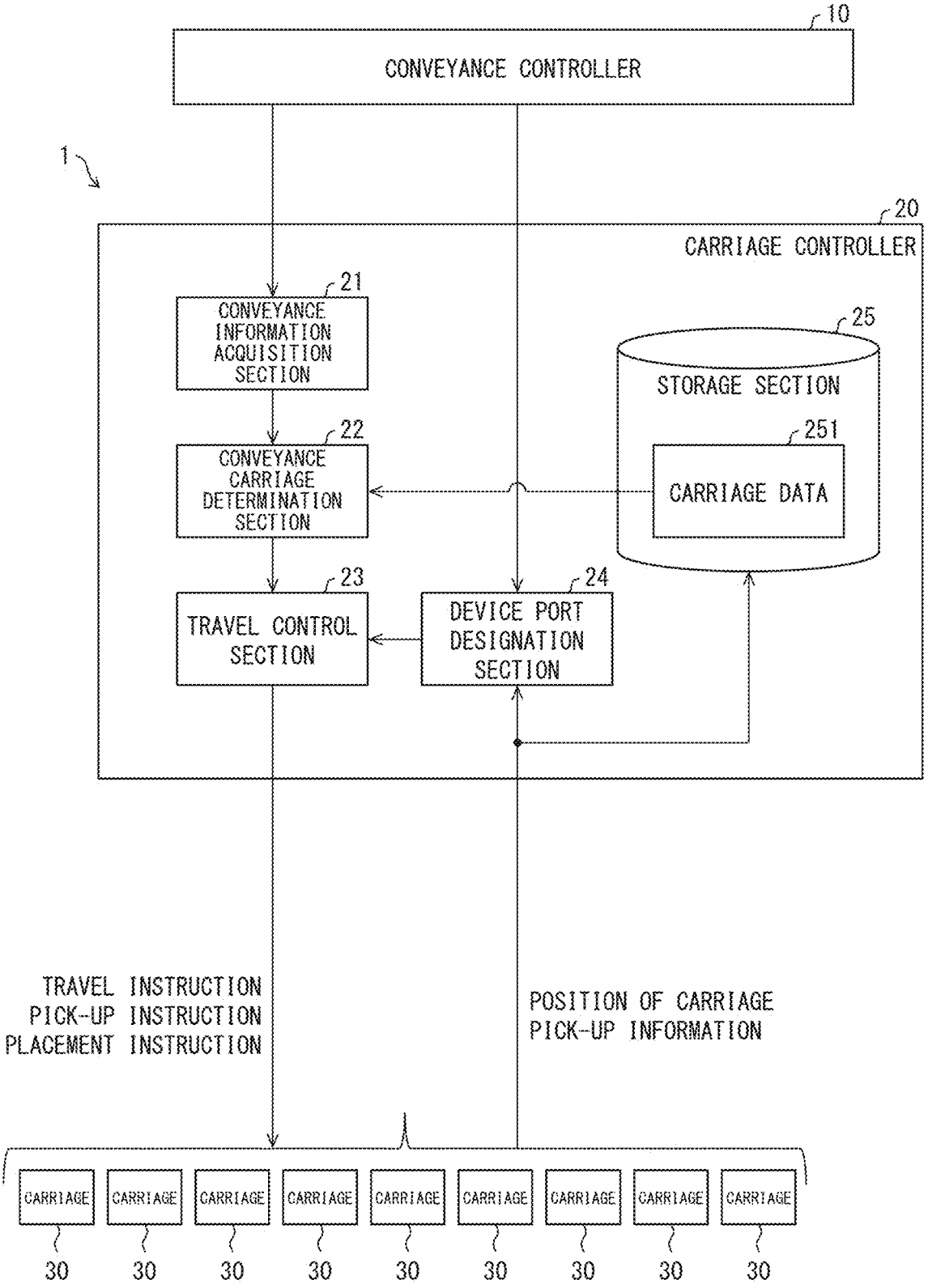
FIG. 3 is a functional block diagram illustrating an outline of the conveyance system.

With reference to FIG. 3, the following will describe details of the carriage controller 20. FIG. 3 is a functional block diagram illustrating an outline of the conveyance system 1. As illustrated in FIG. 3, the carriage controller 20 includes a conveyance information acquisition section 21, a conveyance carriage determination section 22, a travel control section 23, a device port designation section 24, and a storage section 25.

The conveyance information acquisition section 21 acquires an instruction on conveyance of a new conveyance target F from the conveyance controller 10. The "instruction on conveyance" is, for example, information on a departure place and a destination. The "new conveyance target F" is a conveyance target F which has not yet been conveyed and to which a carriage 30 to convey the conveyance target F has not been allocated.

The conveyance carriage determination section 22 determines a conveyance carriage, which is a carriage 30, for conveying a conveyance target F, on the basis of the instruction on conveyance that has been acquired by the conveyance information acquisition section 21. Specifically, when the conveyance information acquisition section 21 has acquired the conveyance information, the conveyance carriage determination section 22 determines, to be the conveyance carriage, a carriage 30 that is located closest to a departure place of the conveyance target F among: empty carriages, that is, carriages 30 that convey no conveyance targets F; and carriages 30 having already being conveying respective other conveyance targets F that are to be conveyed to the same destination bay as the conveyance target F, a departure place of which is located on the conveyance route of the other conveyance targets F. Note that the flow of the process performed by the conveyance carriage determination section 22 will be described later.

This enables an additional conveyance target F to be obtained on a conveyance route of a conveyance target F which has already been being conveyed. Thus, it is possible to convey the additional conveyance target F without decreasing the efficiency of conveying the conveyance target F which has already been being conveyed.

In other words, it can be said that the conveyance carriage determination section 22 performs a process of allocating, to a carriage 30, a conveyance target F to be conveyed. In addition, it can be also said that the carriage controller 20 performs a process of allocating, to a carriage 30, a conveyance target F to be conveyed.

The travel control section 23 performs control of travel of the carriages 30 and control of the transfer sections 31. More specifically, the travel control section 23 performs, with respect to the carriages 30, for example, a control of the travel to the departure place and the destination, a control of pick-up of the conveyance target F at the departure place, and a control of placement of the conveyance target F at the destination.

The device port designation section 24 performs a process of designating the device port 51 on which the conveyance target F being conveyed by the carriage 30 is to be placed. More specifically, when the carriage 30 approaches a destination bay, the device port designation section 24 inquires of the conveyance controller 10 as to the device port 51. Then, the device port designation section 24 instructs, via the travel control section 23, the carriage 30 to place the conveyance target F onto the device port 51 which has been designated by the conveyance controller 10. Whether the carriage 30 has approached the destination bay can be determined depending on whether the carriage 30 has entered a range having a predetermined distance from the destination bay.

This makes it possible to avoid an inconvenient situation in which an empty device port 51 having been allocated to a conveyance target F which is located distant from the empty device port 51 cannot be allocated to another conveyance target F which is located close to the empty device port 51.

The storage section 25 stores carriage data 251. FIG. 4 illustrates an example of the carriage data 251. The carriage data 251 in FIG. 4 shows an example of data on the carriage 30 illustrated in the reference number 201 of FIG. 2. Further, the carriage data 251' in FIG. 4 shows an example of data on the carriage 30' illustrated in the reference number 202 of FIG. 2.

In addition, the storage section 25 may store, for example, map information including a layout of the track 40 that runs around across the first bay 101 to the sixth bay 106 and runs in each bay and information on the processing devices 50 disposed in each bay.

The carriage data 251 shows a carriage ID, a state of a transfer section A, a state of a transfer section B, a destination, and a current position. The carriage ID is identification information for specifying each of the carriages 30. The state of the transfer section A and the state of the transfer section B each indicate whether each transfer section is conveying a conveyance target F. Here, a box in which the identification information (for example, FOUPaaaa) for specifying a conveyance target F is present indicates that the corresponding transfer section is conveying the conveyance target F, whereas a box in which the identification information for specifying a conveyance target F is not present, that is, a blank box indicates that the corresponding transfer section is not conveying any conveyance target F, that is, the transfer section is empty. The destination indicates a bay which is a destination of the conveyance target F being conveyed. The current position indicates a current position of the carriage 30. The current position may be represented by which section the carriage 30 is located in among predetermined sections into which the track 40 is divided or may be represented by X-Y coordinates of the position of the carriage 30 in an X-Y plane representing a movement range of the carriage 30. The current position of the carriage 30 is transmitted from each carriage 30 to the carriage controller 20 at predetermined intervals.

The first row of the carriage data 251 illustrated in FIG. 4 indicates that: a carriage 30 having a carriage ID "XXX0001" is conveying respective conveyance targets F with use of both two transfer sections 31; the destination is "first bay 101"; and the current position is "aaaaaaa". Similarly, the second row of the carriage data 251 indicates: a carriage 30 having a carriage ID "XXX0002" is conveying respective conveyance targets F with use of both two transfer sections 31; the destination is "first bay 101"; and the current position is "aaaaaab". The same applies to the following rows.

Further, the carriage data 251' shows a carriage ID, a state of a transfer section, a state of a shelf, a destination, and a current position. The state of the shelf indicates whether a conveyance target F is placed on the shelf 32. Here, a box in which identification information (for example, FOUPhhhh) for specifying a conveyance target F is present indicates that the conveyance target F is placed on the shelf, whereas a box in which identification information for specifying a conveyance target F is not present, that is, a blank box indicates that any conveyance target F is not placed on the shelf, that is, the shelf is empty.

For example, the first row of the carriage data 251' indicates that: a carriage 30 having a carriage ID "XXX0001" is conveying respective conveyance targets F with use of both the transfer section 31 and the shelf 32; the destination is "first bay 101"; and the current position is "aaaaaaa". Similarly, the second row of the carriage data 251' indicates: in the carriage 30 having a carriage ID "XXX0002", the transfer section 31 is empty, and a conveyance target F is placed on the shelf 32; the destination is "first bay 101"; and the current position is "aaaaaab". The same applies to the following rows.

As described above, the conveyance system 1 in accordance with the present embodiment includes: the one or more carriages 30 each of which can convey the plurality of conveyance targets F; and the carriage controller 20 configured to perform an allocation process of allocating, to the carriage 30, the conveyance target F to be conveyed. The carriage controller 20 performs the allocation process such that, in a case where a region in which the carriages 30 are movable is divided into a plurality of areas (the first bay 101 to the sixth bay 106), areas of destinations of the plurality of conveyance targets F that are to be simultaneously conveyed by each of the carriages 30 are the same.

Accordingly, the carriages 30 are allocated such that the areas of destinations of the plurality of conveyance targets F that are to be simultaneously conveyed by each of the carriages 30 are the same. This makes it possible to achieve the improvement in conveyance efficiency.

Flow of Process

Figure 5:
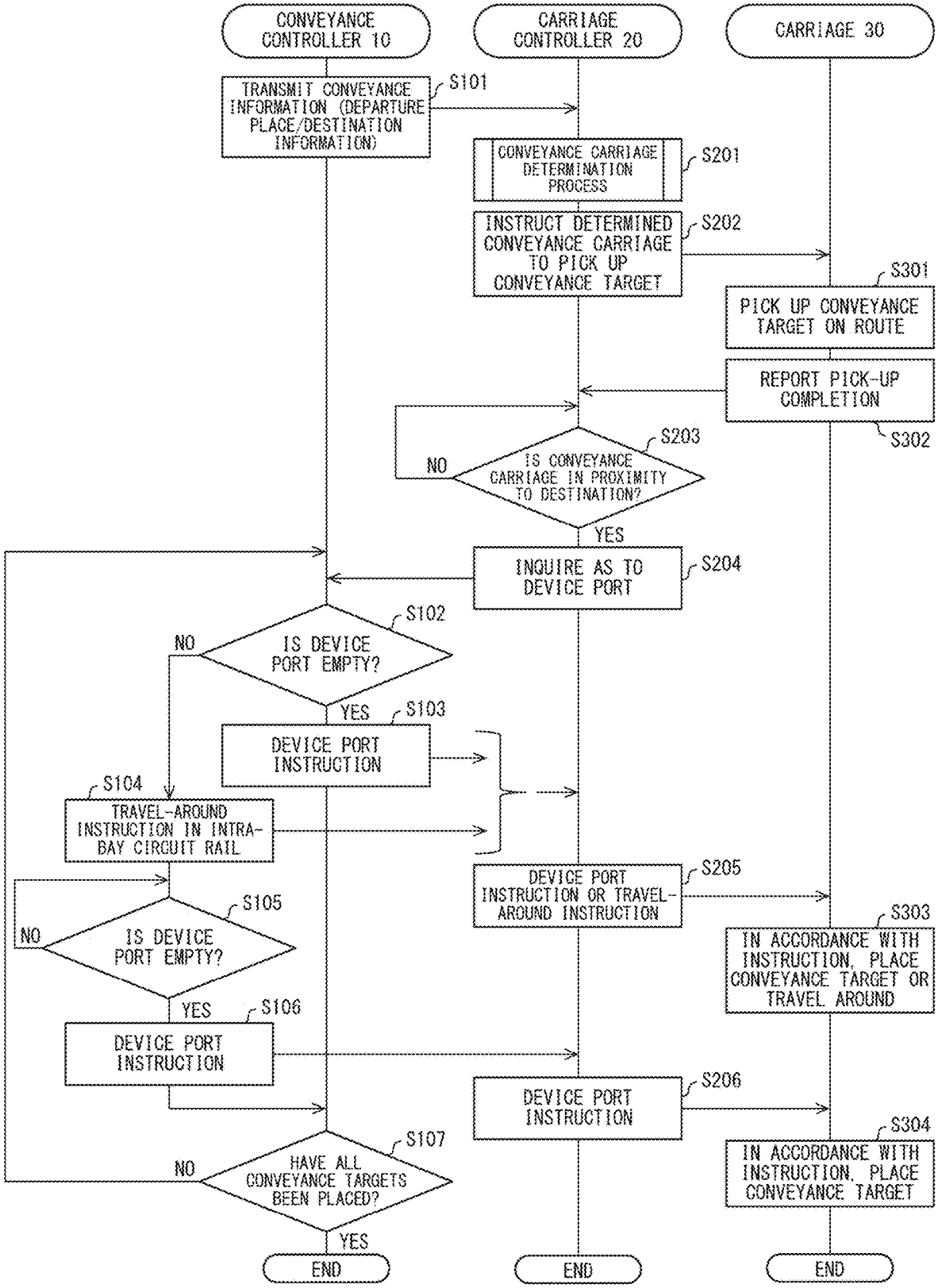
FIG. 5 is a flowchart illustrating a flow of a process in the conveyance system.
Figure 6:
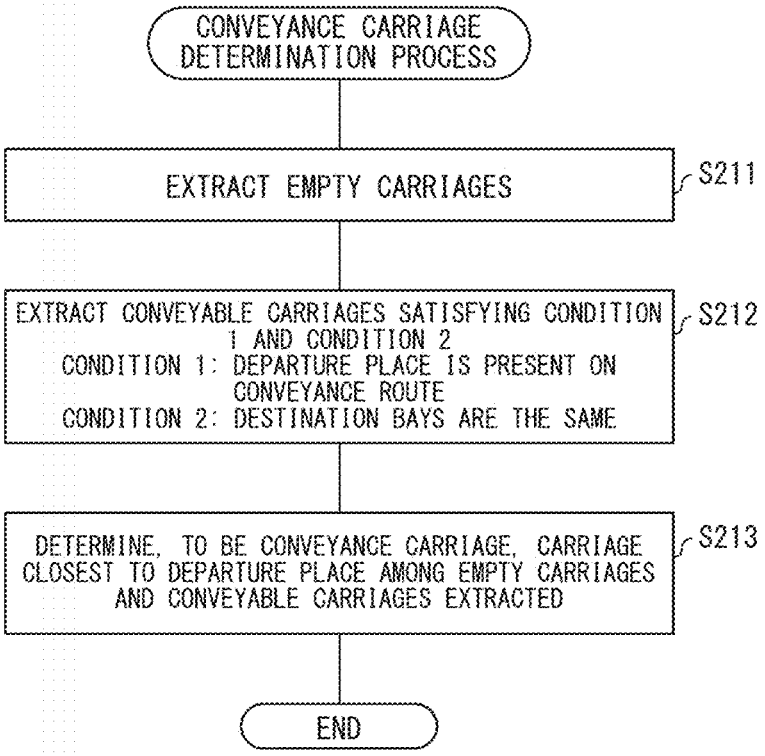
FIG. 6 is a flowchart illustrating a detailed flow of a conveyance carriage determination process.
Figure 7:
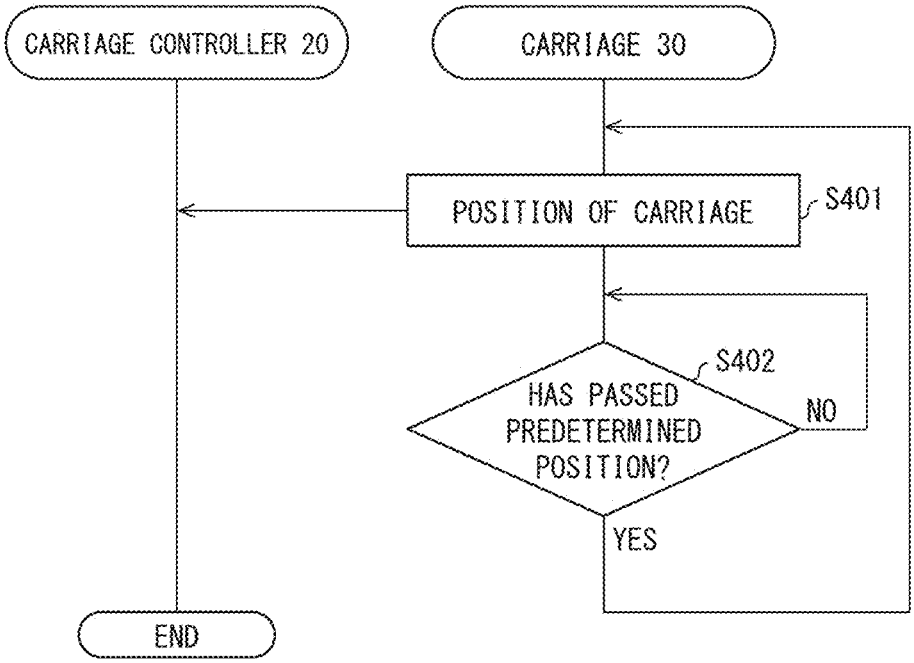
FIG. 7 is a flowchart illustrating a flow of a process of transmitting a position of a carriage.

Next, with reference to FIGS. 5 to 7, the following will describe a flow of a process in the conveyance system 1. FIG. 5 is a flowchart illustrating the flow of the process in the conveyance system 1.

As illustrated in FIG. 5, first, the conveyance controller 10 transmits conveyance information to the carriage controller 20 (S101). The conveyance information is information on conveyance and is information on a departure place of a conveyance target F to be conveyed and a destination thereof. Upon receiving the conveyance information (acquisition step), the carriage controller 20 performs a conveyance carriage determination process of determining a carriage that is caused to convey the conveyance target F (S201, allocation step). The conveyance carriage determination process will be described later in detail.

When having determined a carriage 30 to convey a conveyance target F in the conveyance carriage determination process, the carriage controller 20 instructs the carriage 30 to pick up the conveyance target F (S202).

The carriage 30 which has been instructed by the carriage controller 20 to pick up the conveyance target F travels toward a device port 51 on which the conveyance target F is placed and picks up the conveyance target F (S301). On completion of the pick-up, the carriage 30 reports the completion to the carriage controller 20 (S302).

Then, the carriage 30 travels to the destination of the conveyance target F, and when the carriage 30 approaches the proximity of the destination (YES in S203), the device port designation section 24 of the carriage controller 20 inquires of the conveyance controller 10 as to the device port 51 on which the conveyance target F is to be placed (S204).

The conveyance controller 10 which has been inquired of as to the device port 51 checks whether the processing device 50 for which the conveyance target F is to be placed has any empty device port 51 (S102). If the processing device 50 has an empty device port 51, the conveyance controller 10 instructs the carriage controller 20 to place the conveyance target F onto the empty device port 51 (S103). Upon receiving the instruction, the carriage controller 20 controls the carriage 30 to cause the carriage 30 to place the conveyance target F onto the empty device port 51 (S205), and the carriage 30 places the conveyance target F onto the empty device port 51 in accordance with the control performed by the carriage controller 20 (S303).

If the processing device 50 has no empty device port 51 (NO in S102), the conveyance controller instructs the carriage controller 20 to cause the carriage 30 to travel around on the intra-bay circular track 42 (S104). Upon receiving the instruction, the carriage controller 20 controls the carriage 30 to cause the carriage 30 to travel around on the intra-bay circular track 42 (S205), and the carriage 30 travels around on the intra-bay circular track 42 in accordance with the control performed by the carriage controller 20 (S303).

As such, in a case where the processing device 50 has no empty device port 51, the carriage 30 travels around on the intra-bay circular track 42 and thus does not go out of the bay. Therefore, when a device port 51 becomes empty, the conveyance target F can be promptly placed onto the empty device port 51. In addition, causing the carriage 30 to travel around on the intra-bay circular track 42 is less likely to interfere with another carriage 30. Thus, it is possible to prevent a decrease in overall conveyance efficiency.

After the conveyance controller 10 has instructed the carriage 30 to travel around on the intra-bay circular track 42 in the step S104, the conveyance controller 10 waits for the device port 51 to become empty. When a device port 51 becomes empty (YES in S105), the conveyance controller 10 instructs the carriage controller 20 so that the conveyance target F is placed onto the empty device port 51 (S106). Upon receiving the instruction, the carriage controller 20 controls the carriage 30 to cause the carriage 30 to place the conveyance target F onto the empty device port 51 (S206), and the carriage 30 places the conveyance target F onto the empty device port 51 (S304) in accordance with the control performed by the carriage controller 20. That is, the carriage 30 travels around on the intra-bay circular track 42 until a device port 51 becomes empty.

Subsequently, the conveyance controller 10 checks whether all the conveyance targets F conveyed by the carriage 30 which has been instructed by the conveyance controller 10 to place the conveyance targets F have been placed on respective device ports 51 (S107). If any of the conveyance targets F remains (NO in S107), the process returns to the step S102. If all the conveyance targets F have been placed (YES in S107), the process ends.

Note that, in a case where the carriage 30 does not receive any instruction as to the device port 51 from the carriage controller 20 even when having entered the destination bay, the carriage 30 travels around in the intra-bay circular track 42 in the destination bay.

Conveyance Carriage Determination Process

Next, with reference to FIG. 6, the following will describe a flow of the conveyance carriage determination process at the step S201. FIG. 6 is a flowchart illustrating a flow of the conveyance carriage determination process. As illustrated in FIG. 6, in the conveyance carriage determination process, the conveyance carriage determination section 22 of the carriage controller 20 extracts, among carriages 30 traveling on the track 40, empty carriages, that is, carriages 30 each of which is conveying no conveyance target F (S211). Subsequently, the conveyance carriage determination section 22 extracts carriages 30 (conveyable carriages) each satisfying conditions 1 and 2 described below (S212) among carriages 30 each of which is conveying only one conveyance target F, that is, carriages 30 each of which can convey one more conveyance target F.

Condition 1: A departure place of a new conveyance target F to be conveyed is present on a conveyance route of a conveyance target F which has been being conveyed by the carriage 30.

Condition 2: A bay of a destination of a conveyance target F which has been being conveyed by the carriage and a bay of a destination of a new conveyance target F to be conveyed are the same.

Then, the conveyance carriage determination section 22 determines, among empty carriages extracted in the step S211 and the conveyable carriages extracted in the step S212, the carriage 30 closest to the departure place to be the conveyance carriage which is the carriage 30, for conveying a new conveyance target F (S213).

In a case where an empty carriage 30 is selected as the conveyance carriage, the new conveyance target F to be conveyed is a first conveyance target F for the carriage 30. In a case where a carriage 30 which has been conveying another conveyance target F is selected as the conveyance carriage, the new conveyance target F to be conveyed is a second conveyance target F for the carriage 30, that is, an additional conveyance target F.

Process of Providing Notification of Position of Carriage 30

Further, the carriage 30 regularly notifies, of the position of the carriage 30, the carriage controller FIG. 7 illustrates a flow of the process in which the carriage 30 notifies, of the position of the carriage the carriage controller 20. As illustrated in FIG. 7, the carriage 30 transmits the position of the carriage to the carriage controller 20 (S401). Then, when the carriage 30 passes a predetermined position (YES in S402), the process returns to the step S401, and the carriage transmits the position of the carriage 30 to the carriage controller 20 again. As described above, the carriage 30 regularly transmits the position of the carriage 30 to the carriage controller 20. Note that, the plurality of predetermined positions are provided on the track 40, and every time the carriage 30 passes each of the plurality of predetermined positions, the carriage 30 transmits positional information of the predetermined position as the position of the carriage 30.

Conveyance Example of Conveyance Target F

Figure 8:
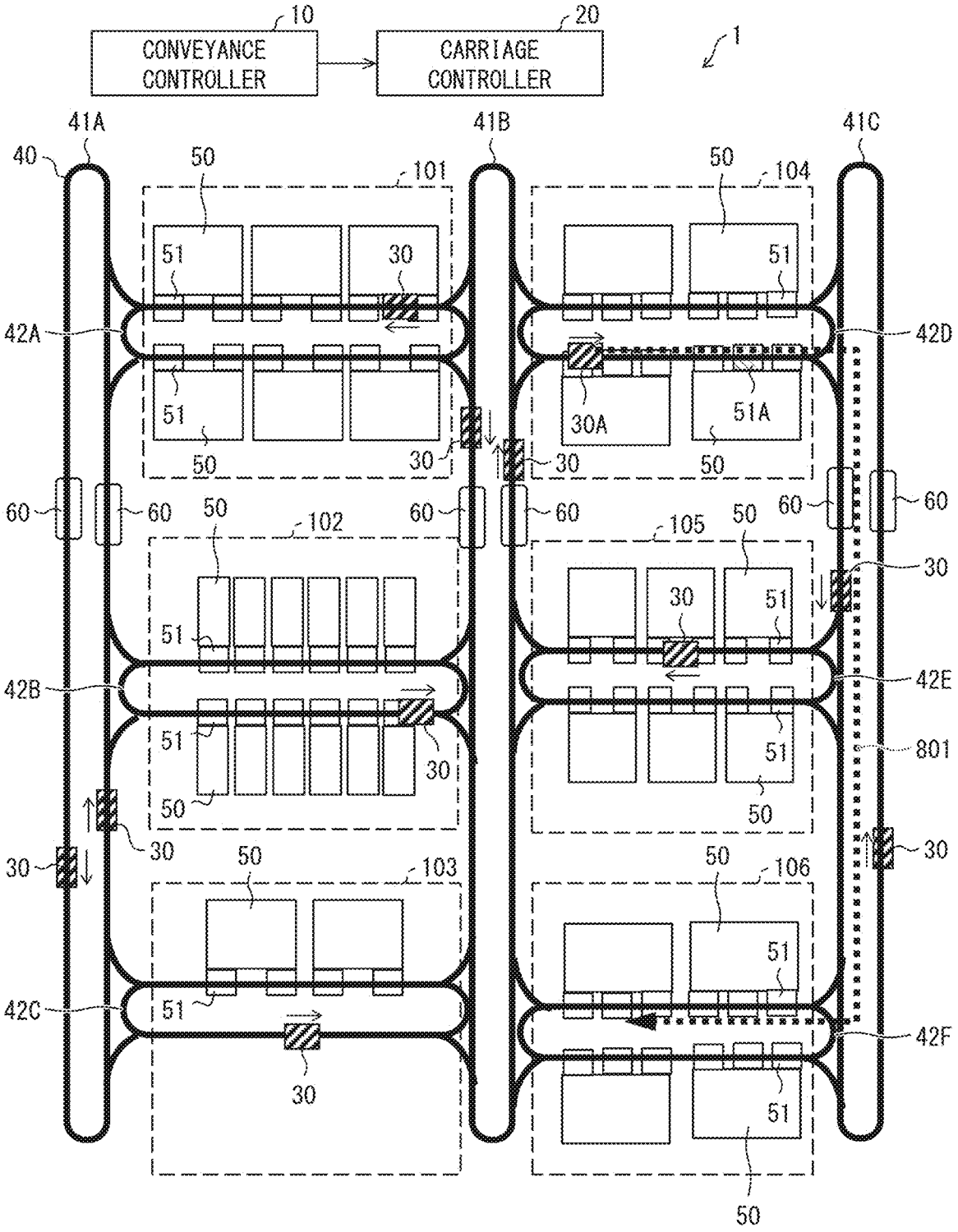
FIG. 8 is a view for describing an example of conveyance of a conveyance target.

Next, with reference to FIG. 8, the following will describe a conveyance example of the conveyance target F. FIG. 8 is a view for describing a conveyance example of the conveyance target F.

FIG. 8 illustrate an example of a case where a conveyance target F placed on a device port 51A in the fourth bay 104 is conveyed to a processing device 50 in the sixth bay 106. It is assumed that, for example, a carriage 30A is conveying another conveyance target F, and the destination of the another conveyance target F is the sixth bay 106. In this case, the device port 51A is present on the route along which the another conveyance target F is conveyed, and both the conveyance target F on the device port 51A and the another conveyance target F are to be conveyed to the sixth bay 106. Thus, the carriage 30A is determined to be a conveyance carriage for the conveyance target F placed on the device port 51A. The carriage 30A that has been determined to be the conveyance carriage picks up the conveyance target F at the device port 51A located on the route along which the another conveyance target F is conveyed. Then, the carriage 30A moves from the intra-bay circular track 42D to the inter-bay circular track 41C and travels along the inter-bay circular track 41C to move to the intra-bay circular track 42F that runs around in the sixth bay 106. Subsequently, the carriage moves to the intra-bay circular track 42F and travels along the intra-bay circular track 42F to place the conveyance target F onto the device port 51 of the processing device 50 in the sixth bay 106, which is the destination (dashed arrow 801 in FIG. 8).

As such, the conveyance system 1 makes it possible to efficiently perform, with use of the carriage 30A, conveyance of an additional conveyance target F together with conveyance of a conveyance target F that has been being conveyed. Note that the conveyance target F to be picked up is not limited to the one placed on the device port 51 of the processing device 50 but may be the one placed in the ceiling storage shelf 60.

Software Implementation Example

The functions of the conveyance controller 10 and the carriage controller 20 (hereinafter, which are referred to as "device") can be realized by a program for causing a computer to function as the device, the program causing the computer to function as the control blocks (in particular, the conveyance information acquisition section 21, the conveyance carriage determination section 22, the travel control section 23, and the device port designation section 24) of the device.

In this case, the device includes a computer that has at least one control device (for example, a processor) and at least one memory device (for example, a memory) as hardware for executing the program. By the control device and the storage device executing the program, the functions described in the above embodiments are realized.

The program can be stored in one or more non-transitory computer-readable storage media. The one or more storage media may or may not be provided to the device. In the latter case, the program may be supplied to or made available to the device via any wired or wireless transmission medium.

Further, some or all of the functions of the control blocks can be realized by a logic circuit. For example, the present invention encompasses, in its scope, an integrated circuit in which a logic circuit that functions as each of the control blocks is formed. In addition, the function of each of the control blocks can be realized by, for example, a quantum computer.

Further, each of the processes described in the above embodiments can be executed by artificial intelligence (AI). In this case, the AI may be operated by the control device or may be operated by another device (for example, an edge computer and a cloud server).

The present invention is not limited to the embodiments, but can be altered by a skilled person in the art within the scope of the claims. The present invention also encompasses, in its technical scope, any embodiment derived by combining technical means disclosed in differing embodiments. Further, it is possible to form a new technical feature by combining the technical means disclosed in the respective embodiments.

REFERENCE SIGNS LIST

1 Conveyance system
10 Conveyance controller (control device)
20 Carriage controller (control device)
21 Conveyance information acquisition section
22 Conveyance carriage determination section
23 Travel control section
24 Device port designation section
25 Storage section
251 Carriage data
30 Carriage
31 Transfer section
311 Raising and lowering part

312 Gripping part
32 Shelf
40 Track
41, 41A, 41B, 41C Inter-bay circular track (first circular track)
42, 42A, 42B, 42C, 42D, 42E, 42F Intra-bay circular track (second circular track)
50 Processing device
51 Device port
60 Ceiling storage shelf
101 First bay
102 Second bay
103 Third bay
104 Fourth bay
105 Fifth bay
106 Sixth bay
F Conveyance target

The invention claimed is:

1. A conveyance system comprising:

a carriage, having at least two transfer sections, configured to be capable of conveying a plurality of conveyance targets; and a control device configured to perform an allocation process of allocating, to the carriage, a conveyance target to be conveyed, the control device performing the allocation process such that, in a case where a region in which the carriage is movable is divided into a plurality of areas, areas of destinations of the plurality of conveyance targets that are to be simultaneously conveyed by the carriage are the same, wherein the control device is configured to extract, among carriages traveling on a track, available carriages based on a departure place of another conveyance target to be conveyed being present on a conveyance route of the conveyance target being conveyed by the carriage, and a destination of the conveyance target being conveyed by the carriage and a destination of the another conveyance target to be conveyed are the same.

2. The conveyance system according to claim 1, wherein:

the carriage is configured to travel along a track; and the track includes:

a first circular track that runs around across the plurality of areas; and second circular tracks each of which branches from the first circular track, the second circular tracks running around in the respective plurality of areas.

3. The conveyance system according to claim 2, wherein:

each of the plurality of areas includes a plurality of processing devices configured to perform identical or analogous processes; and each of the plurality of processing devices includes at least one device port on which the conveyance target to be processed by the processing device is to be placed.

4. The conveyance system according to claim 3, wherein, in a case where the carriage has entered a range having a predetermined distance from the area to which the conveyance target being conveyed by the carriage is to be conveyed, the control device designates the device port on which the conveyance target is to be placed.

5. The conveyance system according to claim 1, wherein, in a case where the control device causes the carriage to convey an additional conveyance target, which is the conveyance target to be additionally conveyed, while the carriage is conveying the conveyance target, the control device determines, to be the additional conveyance target, a conveyance target on a route along which the conveyance target being conveyed by the carriage is conveyed.

6. The conveyance system according to claim 3, wherein, in a case where the device port on which the conveyance target is to be placed is unavailable in the area which is the destination of the conveyance target, the control device causes the carriage which is conveying the conveyance target to travel around on the second circular track that runs around in a respective area.

7. A method for controlling a conveyance system including a plurality of carriages each configured to be capable of conveying a plurality of conveyance targets, the method comprising the steps of:

acquiring conveyance information including a departure place of a conveyance target to be conveyed and a destination of the conveyance target;

allocating, to a first carriage, the conveyance target to be conveyed with use of the conveyance information such that, in a case where a region in which the first carriage is movable is divided into a plurality of areas, areas of destinations of the plurality of conveyance targets that are to be simultaneously conveyed by the first carriage are the same; and extracting, among carriages traveling on a track, available carriages based on a departure place of another conveyance target to be conveyed being present on a conveyance route of the conveyance target being conveyed by the carriage, and a destination of the conveyance target being conveyed by the carriage and a destination of the another conveyance target to be conveyed are the same.

8. A non-transitory computer-readable storage medium storing therein a control program causing a computer to perform the control method according to claim 7.

9. A conveyance system comprising:

a carriage configured to be capable of conveying a plurality of conveyance targets; and a control device configured to perform an allocation process of allocating, to the carriage, a conveyance target to be conveyed, the control device performing the allocation process such that, in a case where a region in which the carriage is movable is divided into a plurality of areas, areas of destinations of the plurality of conveyance targets that are to be simultaneously conveyed by the carriage are the same, and, in a case where the carriage allocated is empty, performing allocation such that the carriage allocated conveys a plurality of the conveyance targets.

* * * * *